US009336671B2

(12) United States Patent
Irumano

(10) Patent No.: US 9,336,671 B2
(45) Date of Patent: May 10, 2016

(54) FIRE DETECTOR

(71) Applicant: Hochiki Corporation, Tokyo (JP)

(72) Inventor: Hidetaka Irumano, Tokyo (JP)

(73) Assignee: Hochiki Corporation, Tokyo (JP)

( * ) Notice: Subject to any disclaimer, the term of this patent is extended or adjusted under 35 U.S.C. 154(b) by 29 days.

(21) Appl. No.: 14/396,241

(22) PCT Filed: Oct. 18, 2012

(86) PCT No.: PCT/JP2012/076931
§ 371 (c)(1),
(2) Date: Oct. 22, 2014

(87) PCT Pub. No.: WO2013/161101
PCT Pub. Date: Oct. 31, 2013

(65) Prior Publication Data

US 2015/0084775 A1 Mar. 26, 2015

(30) Foreign Application Priority Data

Apr. 27, 2012 (JP) ..... 2012-102441

(51) Int. Cl.
*G08B 17/10* (2006.01)
*G08B 17/107* (2006.01)
*G08B 17/103* (2006.01)

(52) U.S. Cl.
CPC ..... *G08B 17/107* (2013.01); *G08B 17/103* (2013.01)

(58) Field of Classification Search
CPC ..... G08B 17/107; G08B 17/00; G08B 17/10
USPC ..... 340/628, 587, 577, 578, 630; 356/337, 356/338, 432; 250/222.2, 554, 573, 574
See application file for complete search history.

(56) References Cited

U.S. PATENT DOCUMENTS 4,594,581 A * 6/1986 Matoba ..... G08B 17/103 340/531
6,288,647 B1 * 9/2001 Yamano ..... G08B 17/107 250/574

(Continued)

FOREIGN PATENT DOCUMENTS

JP 08-128851 A 5/1996
JP 09-035159 A 2/1997

(Continued)

OTHER PUBLICATIONS

Japanese Patent Office, International Search Report issued in corresponding International Patent Application No. PCT/JP2012/076931 and English-language translation, mailed Nov. 27, 2012 (4 pages).

*Primary Examiner* — Toan N Pham
(74) *Attorney, Agent, or Firm* — Wood, Herron & Evans, LLP

(57) ABSTRACT

This fire detector is provided with a light-emitting portion that repeats stopping of light emission and light emission a plurality of number of times in predetermined light emission periods during a predetermined smoke detection operation time set for each first period; a light-receiving portion that receives the light emitted from the light-emitting portion and outputs a light reception signal during the smoke detection operation time; a light reception signal detecting portion that detects as a zero-point light reception signal the light reception signal that the light-receiving portion outputs at each light emission stop timing of the smoke detection operation time, and detects as a smoke light reception signal the light reception signal that the light-receiving portion outputs at each light emission timing; a smoke detecting portion that detects a smoke detection signal based on the zero-point light reception signals of a plurality of number of times and the smoke light reception signals of a plurality of number of times detected by the light reception signal detecting portion; and a noise assessing-processing portion that assesses the presence of mixing-in of noise to the light reception signal based on the zero-point light reception signals of a plurality of number of times and the smoke light reception signals of a plurality of number of times, and carries out noise removal processing in a case of having assessed that the noise is mixed in.

5 Claims, 11 Drawing Sheets

(56) References Cited

U.S. PATENT DOCUMENTS

| | | | | |
|---|---|---|---|---|
| 6,329,922 | B1 * | 12/2001 | Kosugi | G08B 17/107 250/573 |
| 2004/0063154 | A1 * | 4/2004 | Booth | G08B 29/26 435/7.1 |

FOREIGN PATENT DOCUMENTS

| | | | |
|---|---|---|---|
| JP | 11339157 | A | 12/1999 |
| JP | 2011339157 | A | 12/1999 |
| JP | 2001101543 | A | 4/2001 |
| JP | 2011003163 | A | 1/2011 |

* cited by examiner

FIRE DETECTOR

TECHNICAL FIELD

The present invention relates to a fire detector that detects a fire by receiving with a light-receiving portion light from a light-emitting portion that changes in accordance with smoke of a fire.

Priority is claimed on Japanese Patent Application No. 2012-102441, filed Apr. 27, 2012, the content of which is incorporated herein by reference.

BACKGROUND

Conventionally, a photoelectric fire detector that detects smoke due to a fire receives a sampling command every fixed period from a host device such as a receiver or relay to set a predetermined smoke detecting operation time. Also, it drives a light-emitting portion one time during this smoke detecting operation time, receives with a light-receiving portion light scattered by the smoke of a fire among the light from the light-emitting portion and outputs a smoke light reception signal, and based on this smoke light reception signal, detects a smoke detecting signal corresponding to the smoke density and transmits it to the host device. Also, in the case of having detected with the detector itself that the smoke detecting signal is greater than or equal to a predetermined fire threshold value, it transmits a fire interruption signal to the host device, and outputs a fire warning by specifying the fire detector that detected the fire with a search command from the host device.

In this kind of conventional photoelectric (analog-type) fire detector, in the case of noise that enters from the power supply line or noise passing through the air becoming mixed with the light reception signal output from the light-receiving portion, there is the problem of misjudging a fire due to the effect of the noise.

In order to solve this problem, for example, Patent Document 1 discloses a fire detector that, during a smoke detection time that is set in each fixed period, detects as a noise detection signal a zero-point light reception signal that is output from a light-receiving portion at the light emission stop timing of the light-emitting portion, and in the case of the noise detection signal being equal to or greater than a threshold value, judges there to be noise, and carries out predetermined noise removal processing.

This noise removal processing, for example, by not using for the fire judgment the smoke detection signal detected in the case of having assessed noise, but rather using for the fire judgment the smoke detection signal that was detected and held in the period prior to assessing noise, errors in fire judgment due to the influence of noise are prevented.

RELATED ART DOCUMENTS

Patent Documents

[Patent Document 1] Japanese Unexamined Patent Application Publication No. 2001-101543

SUMMARY OF THE INVENTION

Problems to be Solved by the Invention

However, the fire detector of Patent Document 1, by detecting the zero-point light reception signal that is output from the light-receiving portion at the light emission stop timing of the light-emitting portion as a noise detection signal, assesses noise. For that reason, in the case of noise not being mixed in the noise detection signal (zero-point light reception signal), but rather noise being mixed in the smoke light reception signal that the light-receiving portion outputs at the light emission timing of the light-emitting portion, it is not possible to assess noise from the noise detection signal (zero-point light reception signal). Accordingly, in such a case, it is not possible to perform noise removal processing, and so the smoke detection signal that is detected based on the smoke light reception signal fluctuates due to the mixing-in of noise, and so there may be errors in the determination of fires, that is, there is the problem of not being able to sufficiently inhibit the effect of noise.

In order to solve this problem, it is also conceivable to assess noise by detecting as a noise detection signal a smoke light reception signal that the light-receiving portion outputs at the light emission timing of the light-emitting portion. However, the smoke light reception signal is a signal that changes in accordance with the smoke that accompanies a fire, and since it is not possible to distinguish between signal changes due to smoke and noise, it is not possible to use the smoke light reception signal for noise assessment.

The present invention has as its object to provide a fire detector that inhibits the effect of noise by reliably assessing noise that becomes mixed with the light reception signal, and enables prevention of misjudgment of fires due to noise.

Means for Solving the Problems

In order to solve the aforementioned problem and attain the object, the present invention adopts the following means.

(1) That is, the fire detector according to one aspect of the present invention is provided with a light-emitting portion that repeats stopping of light emission and light emission a plurality of number of times in predetermined light emission periods during a predetermined smoke detection operation time set for each first period; a light-receiving portion that receives the light emitted from the light-emitting portion and outputs a light reception signal during the smoke detection operation time; a light reception signal detecting portion that detects as a zero-point light reception signal the light reception signal that the light-receiving portion outputs at each light emission stop timing of the smoke detection operation time, and detects as a smoke light reception signal the light reception signal that the light-receiving portion outputs at each light emission timing; a smoke detecting portion that detects a smoke detection signal based on the zero-point light reception signals of a plurality of number of times and the smoke light reception signals of a plurality of number of times detected by the light reception signal detecting portion; and a noise assessing-processing portion that assesses the presence of mixing-in of noise to the light reception signal based on the zero-point light reception signals of a plurality of number of times and the smoke light reception signals of a plurality of number of times, and carries out noise removal processing in a case of having assessed that the noise is mixed in.

(2) In the fire detector disclosed in the aforementioned (1), the light emission periods may be set to periods that differ from a noise period corresponding to a predetermined noise frequency.

(3) In the fire detector disclosed in the aforementioned (1), the noise assessing-processing portion may be provided with a first noise assessment mode that assesses the noise as being mixed in when any of the zero-point light reception signals of a plurality of number of times is equal to or greater than an upper limit value or equal to or lower than a lower limit value of a predetermined range centered on a predetermined zero-point moving average value; a second noise assessment mode that assesses the noise as being mixed in when the moving average value of the zero-point light reception signals of a plurality of number of times is equal to or greater than an upper limit value or equal to or lower than a lower limit value of a predetermined range centered on a predetermined zero-point fixed value; a third noise assessment mode that assesses the noise as being mixed in when the difference between the maximum value and the minimum value of the smoke light reception signals of a plurality of number of times is greater than or equal to a predetermined threshold value; a fourth noise assessment mode that assesses the noise as being mixed in when the difference between the maximum value and the minimum value of the zero-point light reception signals of a plurality of number of times is greater than or equal to a predetermined threshold value; and a fifth noise assessment mode that assesses the noise as being mixed in when any of the zero-point light reception signals of a plurality of number of times exceeds the smoke light reception signals detected next, and the noise assessing-processing portion may carry out the noise removal processing in a case of having assessed that the noise is mixed in based on one or multiple combinations of the first noise assessment mode to the fifth noise assessment mode.

(4) In the fire detector disclosed in the aforementioned (1), the smoke detecting portion may update a first zero-point moving average value, which is calculated from a predetermined number of zero-point light reception signals detected by the previous period and held, as a second zero-point moving average value based on the zero-point light reception signals of a plurality of number of times, and detects the smoke detection signal based on this second zero-point moving average value and the smoke light reception signals of a plurality of number of times; and the noise assessing-processing portion, in the case of having assessed noise to be mixed in, carries out noise removal processing that prohibits updating of the first zero-point moving average value by the smoke detecting portion.

(5) In the fire detector disclosed in the aforementioned (1), the noise assessing-processing portion may change the first period to a second period that is shorter when it has assessed that noise is mixed in; and may return the second period to the first period after being changed to the second period and when it no longer assesses that noise to be mixed in.

(6) In the fire detector disclosed in the aforementioned (4), the smoke detecting portion may find the average value of the values obtained by subtracting the first zero-point moving average value or the second zero-point moving average value from each of the smoke light reception signals of a plurality of number of times as the smoke detection signal.

Advantage of the Invention

In the fire detector disclosed in the aforementioned (1), stopping of light emission and light emission of the light-emitting portion are repeated a plurality of number of times in predetermined light emission periods during a predetermined smoke detection operation time set for each predetermined first period, and a light reception signal that the light-receiving portion outputs at each light emission stop timing of the smoke detection operation time is detected as a zero-point light reception signal. Moreover, the light reception signal that the light-receiving portion outputs at each light emission timing is detected as a smoke light reception signal, and noise assessment is performed that assesses whether or not noise is mixed in the light reception signal based on the zero-point light reception signals of a plurality of number of times and the smoke light reception signals of a plurality of number of times detected by the light reception signal detecting portion. For that reason, it is possible to reliably assess noise and perform noise removal processing without missing the occurrence state of varying noise such as instantaneous noise in which noise mixes into either one or both of the zero-point light reception signal of the light emission stop timing and the smoke light reception signal of the light emission timing, randomly generated noise, or noise that continues for a comparatively long time. As a result, it is possible to judge a fire without errors by inhibiting the effect of noise.

In the fire detector disclosed in the aforementioned (2), additionally the light emission periods in which the light-emitting portion emits light a plurality of number of times during the smoke detection operation time that is set in each predetermined period are set to periods differing from noise periods corresponding to a predetermined noise frequency. Thereby, in the case of there being known a noise frequency with a high possibility of affecting the light reception signal, by shifting with respect to the noise period of this noise frequency the light emission periods during which light is emitted a plurality of number of times by the light-emitting portion, it is possible to reduce the degree of noise mixing with the smoke light reception signal that is detected at the light emission timing, and so it is possible to detect a smoke light reception signal with the influence of noise inhibited.

In the fire detector disclosed in the aforementioned (3), additionally the noise assessing-processing portion performs a predetermined noise removal processing in the case of having assessed that noise is mixed in by at least one of a first noise assessment mode to the fifth noise assessment mode on the basis of zero-point light reception signals and smoke light reception signals of a plurality of number of times detected by the light reception signal detecting portion. For that reason, it is possible to reliably assess from the light reception signal various types of noise that are assumed to be mixed in such as instantaneous noise, randomly generated noise, or noise that continues for a comparatively long time, and to perform noise removal processing.

In the fire detector disclosed in the aforementioned (4), by additionally prohibiting updating of the zero-point moving average value when noise is assessed to be mixed in, it is possible to inhibit the zero-point moving average value ($D_0$) ma being affected by noise.

In the fire detector disclosed in the aforementioned (5), moreover the noise assessing-processing portion performs an assessment of whether or not noise is mixed in (noise assessment), and in the case of having assessed that noise is mixed in, by changing the period that sets the smoke detection operation time to a shorter period, it shortens the period of assessing the presence of mixing in of noise thereafter, and so it is possible to raise the frequency of assessing the presence of mixing in of noise. Also, it is possible to rapidly release the noise remove processing in the case of noise no longer being assessed as being mixed in.

In the fire detector disclosed in the aforementioned (6), by moreover repeating stopping of light emission and light emission of a light-emitting portion a plurality of number of times, and finding a smoke detection signal as an average value of the values obtained by subtracting a zero-point moving average value from each of the smoke light reception signals of a plurality of number of times detected at each light emission timing, it is possible to inhibit the effect of fluctuations of the smoke light reception signal due to noise and factors other than noise, and enable stable fire judgment.

BRIEF DESCRIPTION OF THE DRAWINGS

FIG. 4 is a time chart that shows the light emission operation and light reception operation of the smoke detector according to the same embodiment in the case of noise being mixed in.

DESCRIPTION OF THE EMBODIMENTS

Figure 1:
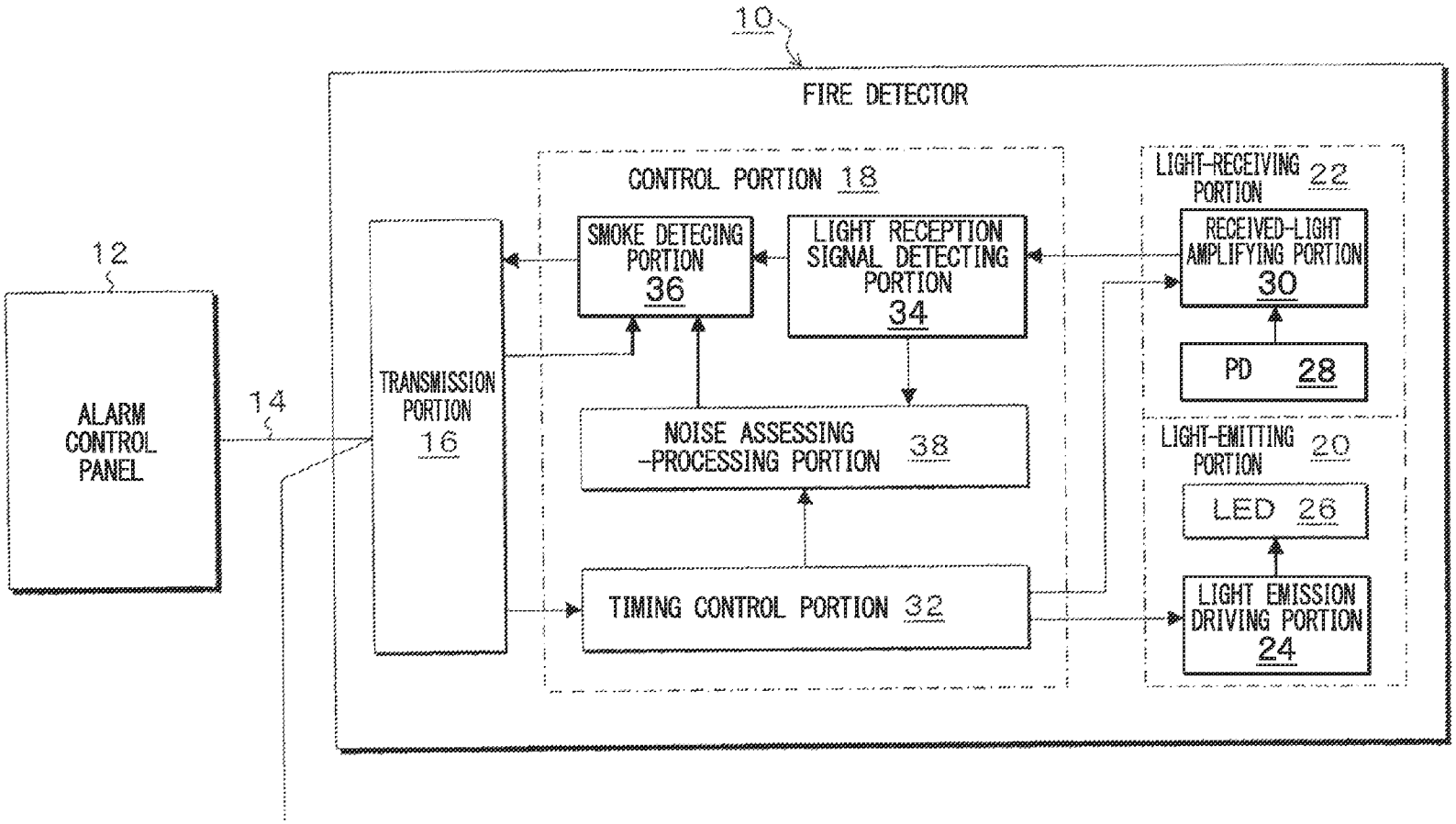
FIG. 1 is a block drawing that shows the fire detector according to one embodiment of the present invention.

Hereinbelow, the embodiment of the present invention shall be described while referring to the drawings. However, the present is not limited to only the embodiment given below.

Figure 2:
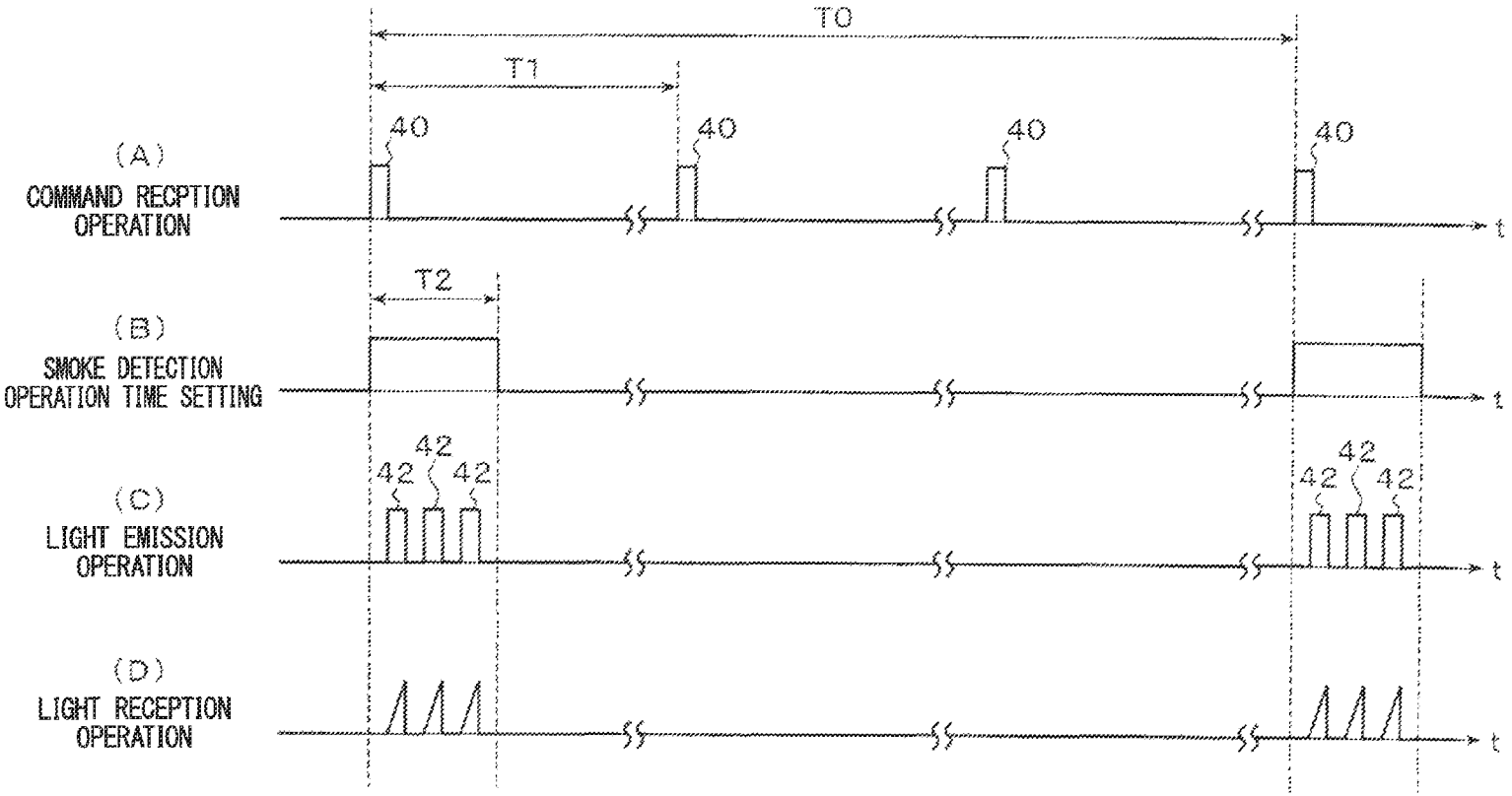
FIG. 2 is time chart that shows the overall operation of the fire detector according to the same embodiment.

FIG. 1 is a block drawing that shows the fire detector according to one embodiment of the present invention. FIG. 2 shows the overall operation of the fire detector, and FIG. 3 breaks out the light emission operation and light reception operation of the smoke detection operation time of FIG. 2. Moreover, FIG. 4 shows the light emission operation and the light reception operation in the case of noise being mixed in.

(Schematic Configuration of Smoke Detector)

As shown in FIG. 1, the smoke detector 10 according to the present embodiment is connected to a transmission path 14 that is drawn out from an alarm control panel 12. There may be one or a plurality of fire detectors 10 connected to the transmission path 14, but hereinbelow the connection of one shall be taken for an example in order to simplify the description.

The fire detector 10 according to the present embodiment is constituted by a transmission portion 16, a control portion 18, a light-emitting portion 20, and a light-receiving portion 22. The light-emitting portion 20 is provided with a light emission driving portion 24 and an infrared LED 26 as a light-emitting element. Moreover, the light-receiving portion 22 is provided with a photodiode (PD) 28 as a light-receiving element and a received-light amplifying portion 30.

The control portion 18 uses a computer circuit or a wired logic circuit provided with a CPU, memory, and various input/output portions including an AD conversion port as hardware, and a timing control portion 32, a light reception signal detecting portion 34, a smoke detecting portion 36 and a noise assessing-processing portion 38 as functions that are for example realized by execution of programs by the CPU.

(Schematic Constitution of Alarm Control Panel)

The alarm control panel 12 can connect for example a maximum of 255 fire detectors 10 via the transmission path 14, and assigns an identification address 1 to 255 to each of the connected fire detectors 10.

The alarm control panel 12 transmits a sampling command (AD conversion command) to each fire detector 10 at every predetermined period, for example, 1 second. Then, the alarm control panel 12 transmits a polling command that designates in sequence that address to the maximum 255 fire detectors 10.

The fire detector 10 sets a smoke detection operation time (fire detection operation time) T2 shown in (B) of FIG. 2 in every predetermined period T0, which equals 3 seconds, of receiving for example three times the sampling command 40 that the alarm control panel 12 has transmitted at for example every predetermined period T1, which equals 1 second, as shown in (A) of FIG. 2. Also, the smoke detector 10, by performing a smoke detection operation during this smoke detection operation time T2, detects and holds a smoke detection signal, and in the case of receiving a polling command (not illustrated) designating its own address from the alarm control panel 12, transmits to the alarm control panel 12 a response signal that includes the value of the smoke detection signal that has been detected and held. Also, the fire detector 10, in the case of detecting a fire from the smoke detection signal detected by performing the smoke detection operation, transmits a fire interruption signal to the alarm control panel 12.

(Constitution of Control Portion)

The control portion 18 of the fire detector 10 controls the light-emitting portion 20 and the light-receiving portion 22, and by light emission driving of the light-emitting portion 20 and the light reception operation of the light-receiving portion 22, detects the smoke detection signal to perform a smoke detection operation that determines a fire (fire detection operation).

Figure 3:
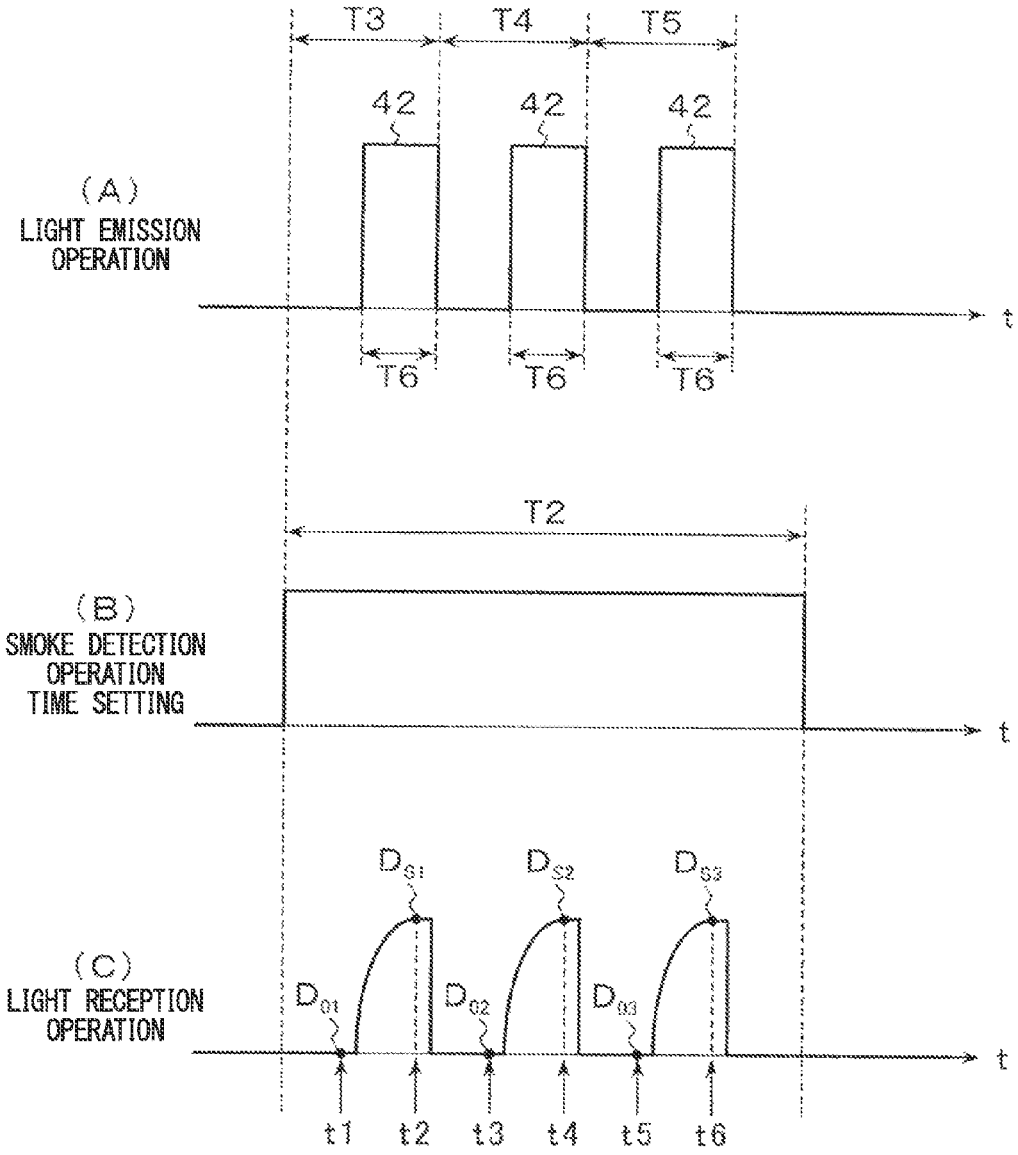
FIG. 3 is a time chart that shows the light emission operation and light reception operation of the smoke detector according to the same embodiment.
Figure 4:
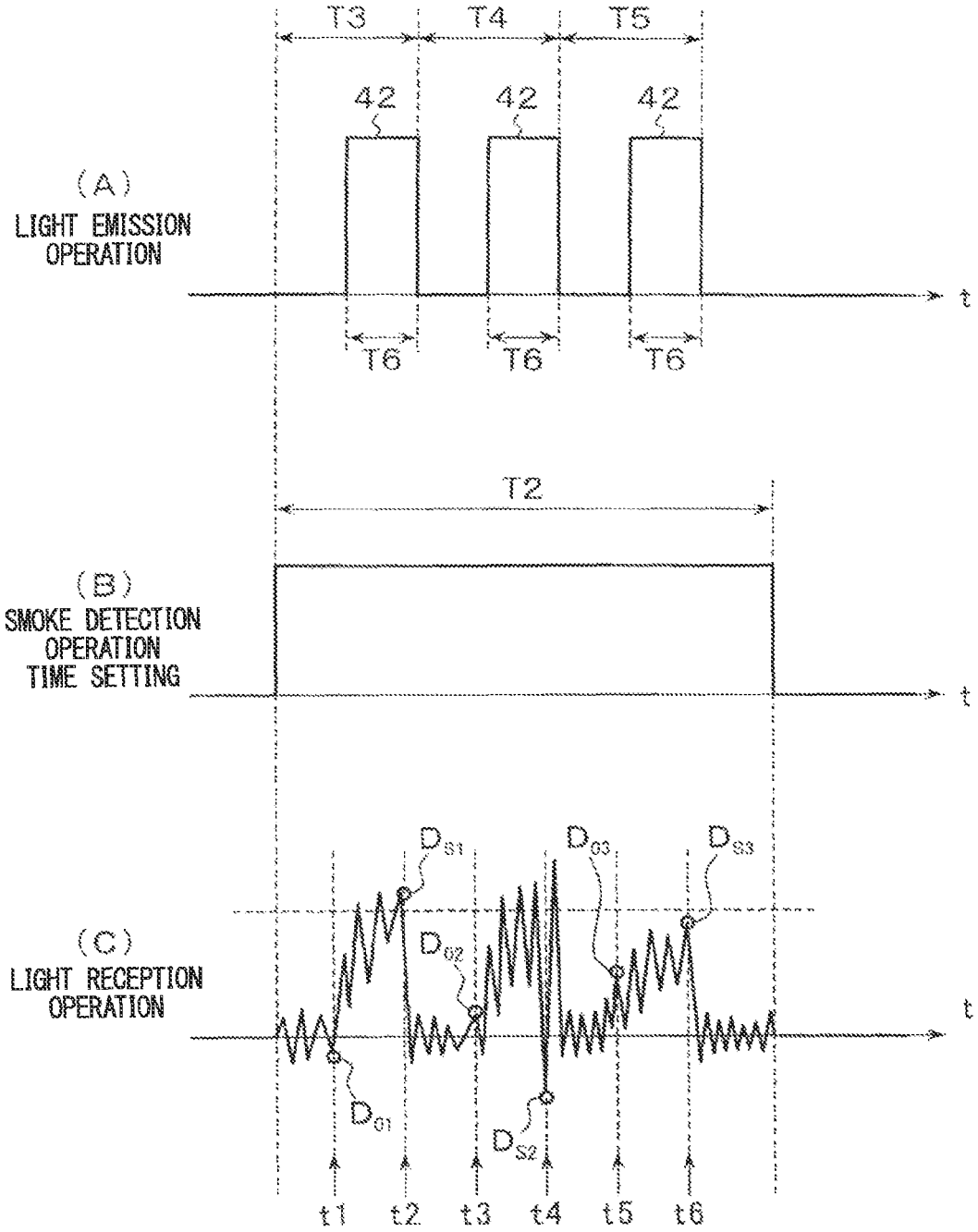

Also, the timing control portion 32 of the control portion 18, in the case of detecting the attainment of the period T0=3 seconds by determining that the sampling command 40 transmitted from the alarm control panel 12 via the transmission portion 16 has been received 3 times as shown in (A) of FIG. 2, sets the predetermined smoke detection operation time T2 shown in (B) of FIG. 3. Moreover, it gives instructions to the received-light amplifying portion 30 of the light-receiving portion 22 and, by putting the received-light amplifying portion 30 into an operation state during the smoke detection operation time T2 by for example turning the power supply on, causes it to perform a light receiving operation. Also, it gives instructions to the light emission driving portion 24 of the light-emitting portion 20 to cause a light emitting operation that outputs a light-emitting signal 42 in a manner of the infrared LED 26 repeating for example three times light emission stoppage and light emission during the smoke detection operation time T2. In the present embodiment, the light emission of the light emission driving portion 24 is repeated three times, but depending on the response performance of the circuit, it may be two times, or it may be four times.

The fire detector 10 according to the present embodiment is provided with a publicly known scattered light-type smoke detecting portion. This scattered light-type smoke detecting portion forms a smoke detection chamber in the interior of a housing that forms a smoke inflow port, and there provides an infrared LED 26 and a photodiode 28. An insect screen is provided on the outer periphery of the smoke detection chamber, and a labyrinth structure is provided on the inner side of the insect screen that passes smoke but shuts off light from the outside. Scattered light that is produced in the case of light from the infrared LED 26 being incident on smoke that has flowed into the smoke detection chamber from the smoke inflow port is received by the photodiode 28 and converted to an electrical signal, and is then amplified by the received-light amplifying portion 30 and outputted as a light reception signal to the light reception signal detecting portion 34 of the control portion 18. The received-light amplifying portion 30 may also be provided in the control portion 18 side.

In the light emission operation of the light-emitting portion 20, as shown in (A) of FIG. 3, during the smoke detection operation time T2, light emission driving that outputs to the infrared LED 26 the light emission signal 42 of a predetermined light emission time T6 is repeated three times during each of the light emission periods T3, T4, and T5. Here, the light emission time T6 by the light emission signal 42 is for example T6=50 microseconds, and the light emission periods T3, T4, T5 are for example around 1 millisecond. Note that the light emission periods T3, T4, T5 may be the same, or may respectively differ.

The light emission periods T3, T4, T5 are preferably set to periods differing from a noise period Tn corresponding to a predetermined noise frequency fn. The noise frequency fn that influences fire detection by mixing with the light reception signal of the fire detector 10 is for example fn=1 kHz. The noise period in this case would be Tn=1 millisecond. Therefore, in the present embodiment, the light emission frequency of the infrared LED 26 is set to for example 0.9 kHz and 1.1 kHz, which are frequencies that differ from the noise frequency fn=1 kHz, with the periods being approximately 1.1 milliseconds and approximately 0.9 milliseconds, respectively. As a result, the light emission periods T3 to T5 of (A) of FIG. 3 are set to for example T3=1.1 milliseconds, T4=0.9 milliseconds, T5=1.1 milliseconds.

In this way, by shifting with respect to the noise period Tn=1 millisecond of a specified noise frequency fn=1 kHz the light emission periods T3 to T5 during which light is emitted a plurality of number of times by the light-emitting portion to for example T3=1.1 milliseconds, T4=0.9 milliseconds, T5=1.1 milliseconds, it is possible to reduce the degree of noise mixing with (synchronizing with) the smoke light reception signal that is detected at the light emission timing, and so it is possible to inhibit the influence of noise.

(Constitution of Light Reception Signal Detecting Portion)

The light reception signal detecting portion 34 of the control portion 18 is provided with an AD conversion port, and performs AD conversion (analog-digital conversion) at each of times t1 to t6 of the light reception signals shown in (C) of FIG. 3 that the light-receiving portion 22 outputs at each light emission stop timing and light emission timing of the three light emission signals 42 by the light-emitting portion 20 in (A) of FIG. 3. That is, the light reception signal detecting portion 34 detects and holds the light reception signal subjected to AD conversion at times t1, t3, t5 corresponding to the light emission stop timing as AD conversion values $D_{01}$, $D_{02}$, $D_{03}$ of zero-point light reception signals, and also detects and holds the light reception signals subjected to AD conversion at times t2, t4, t6 corresponding to the light emission timing as AD conversion values $D_{S1}$, $D_{S2}$, $D_{S3}$ of smoke light reception signals.

In the following description, the AD conversion values of the zero-point light reception signals subjected to AD conversion at the three light emission stop timings are denoted as zero-point light reception values $D_{01}$, $D_{02}$, $D_{03}$, while the AD conversion values of the smoke light reception signals subjected to AD conversion at the three light emission timings are denoted as smoke light reception values $D_{S1}$, $D_{S2}$, $D_{S3}$.

FIG. 4 shows the light emission operation and light reception operation in the case of noise intermittently being mixed in with the light reception signal. The zero-point light reception values $D_{01}$, $D_{02}$, $D_{03}$ detected at the light emission stop timings and the smoke light reception values $D_{S1}$, $D_{S2}$, $D_{S3}$ detected at the light emission timings greatly fluctuate due to the mixing of noise.

(Constitution of Smoke Detecting Portion)

The smoke detecting portion 36 of the control portion 18 detects a smoke detection value D as the smoke detection signal based on the zero-point light reception values $D_{01}$, $D_{02}$, $D_{03}$ and the smoke light reception values $D_{S1}$, $D_{S2}$, $D_{S3}$ detected and held by the light reception signal detecting portion 34.

The detection of the smoke detection value D by the smoke detecting portion 36 is performed by updating a zero-point moving average value $(D_0)$ma, which is calculated from a moving average value $(D_0)$ma of the a zero-point light reception values detected by the previous period, for example, 48 zero-point light reception values of 16 periods, and held, to a zero-point moving average value $(D_0)$ma that is calculated by including this zero-point moving average value (D)ma and the zero-point light reception values $D_{01}$, $D_{02}$, $D_{03}$ detected by the light reception signal detecting portion 34, and subtracting the updated zero-point moving average value (D)ma from the smoke light reception values $D_{S1}$, $D_{S2}$, $D_{S3}$ detected by the light reception signal detecting portion 34. That is, $\{D_{S1}-(D)ma\}$
$\{D_{S2}-(D)ma\}$
$\{D_{S3}-(D)ma\}$ are found, and as the average value of these differences, the smoke detection value D is detected and held.

Note that in the case of $(D_0)$ma not being updated as described below, the smoke detection value D may be detected by subtracting the zero-point moving average value $(D_0)$ma from the smoke light reception values $D_{S1}$, $D_{S2}$, $D_{S3}$.

Also, the smoke detecting portion 36, in the case of having detected the reception of a polling command that designates its own address from the alarm control panel 12 via the transmission portion 16, instructs the transmission portion 16 to transmit to the alarm control panel 12 a response signal that includes the detected smoke detection value D.

Also, the smoke detecting portion 36 detects a fire (judges there to be a fire) in the case of the smoke detection value D that has been detected being equal to or greater than a predetermined fire threshold value, and instructs the transmission portion 16 to transmit a fire interruption signal to the alarm control panel 12. The alarm control panel 12 that has received this fire interruption signal transmits a search command to search for and obtain the address of the fire detector 10 that has transmitted the fire interruption command, and outputs a fire alarm that specifies the fire detector 10 that has detected the fire.

(Constitution of Noise Assessing-Processing Portion)

The noise assessing-processing portion 38 of the control portion 18 performs noise assessment based on the zero-point light reception values $D_{01}$, $D_{02}$, $D_{03}$ and the smoke light reception values $D_{S1}$, $D_{S2}$, $D_{S3}$ detected by the light reception signal detecting portion 34. Also, it carries out a predetermined noise removal processing in the case of having assessed that noise is mixed in.

The noise assessing-processing portion 38 performs a noise assessment process according to the following first noise assessment mode to fifth noise assessment mode, and based on at least one or more assessment modes of the first noise assessment mode to fifth noise assessment mode, preferably carries out noise removal processing in the case of assessing that noise is mixed in.

(First Noise Assessment Mode)

In the first noise assessment mode, the noise assessing-processing portion 38 assesses that noise is mixed in when any of the zero-point light reception values $D_{01}$, $D_{02}$, $D_{03}$ of the three instances detected by the light reception signal detecting portion 34 is equal to or greater than an upper limit value or equal to or lower than a lower limit value of a predetermined range centered on the zero-point moving average value $(D_0)$ma. It is possible to arbitrarily set this predetermined range so as to be a range in which the detector does not malfunction due to noise under an assumed noise intensity environment, and in which it does not mis-detect noise under an ordinary installation environment with no noise.

Figure 5A:
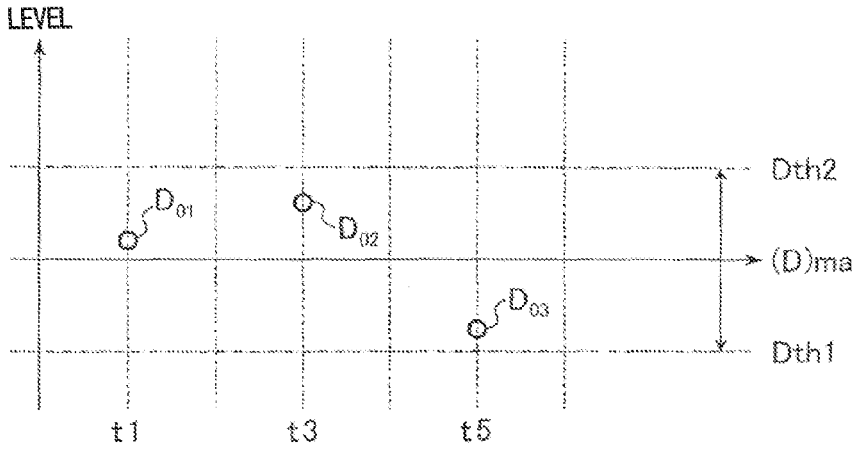
FIG. 5A is an explanatory drawing that shows noise assessment by the first noise assessment mode.
Figure 5B:
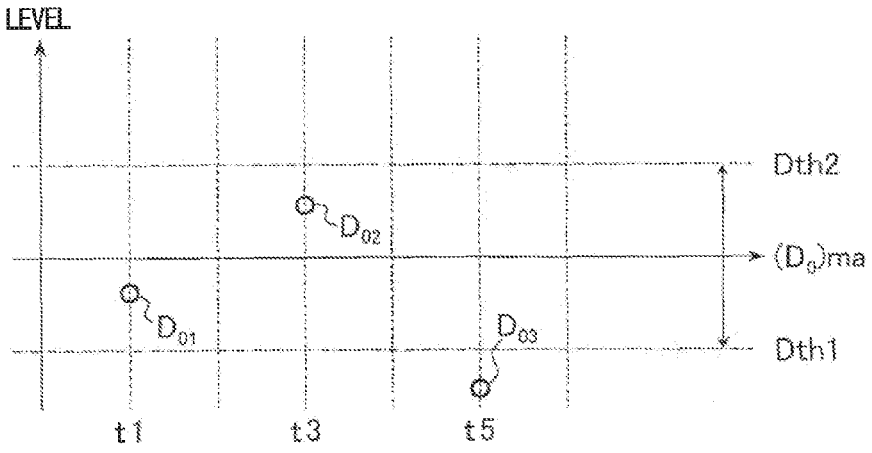
FIG. 5B is an explanatory drawing that shows noise assessment by the first noise assessment mode.

FIG. 5A and FIG. 5B show examples of noise assessment according to the first noise assessment mode. In FIG. 5A, the zero-point light reception values $D_{01}$, $D_{02}$, $D_{03}$ in the case of no noise are within the upper limit value Dth2 and the lower limit value Dth1 that determine the predetermined range centered on the zero-point moving average value $(D_0)$ma. In this case, noise is assessed as not being mixed in. In contrast to this, in the case of noise being mixed in as shown in FIG. 5B, among the zero-point light reception values $D_{01}$, $D_{02}$, $D_{03}$, the zero-point light reception value $D_{03}$ is below the lower limit value Dth1 of the predetermined range centered on the zero-point moving average value $(D_0)$ma. In this case, noise is assessed as being mixed in.

(Second Noise Assessment Mode)

In the second noise assessment mode, the noise assessing-processing portion 38 assesses noise as being mixed in when the moving average value of the zero-point light reception values $D_{01}$, $D_{02}$, $D_{03}$ of the three instances detected by the light reception signal detecting portion 34 is equal to or greater than an upper limit value or equal to or lower than a lower limit value of a predetermined range centered on a predetermined zero-point fixed value (zero-point moving average initial value).

Figure 6A:
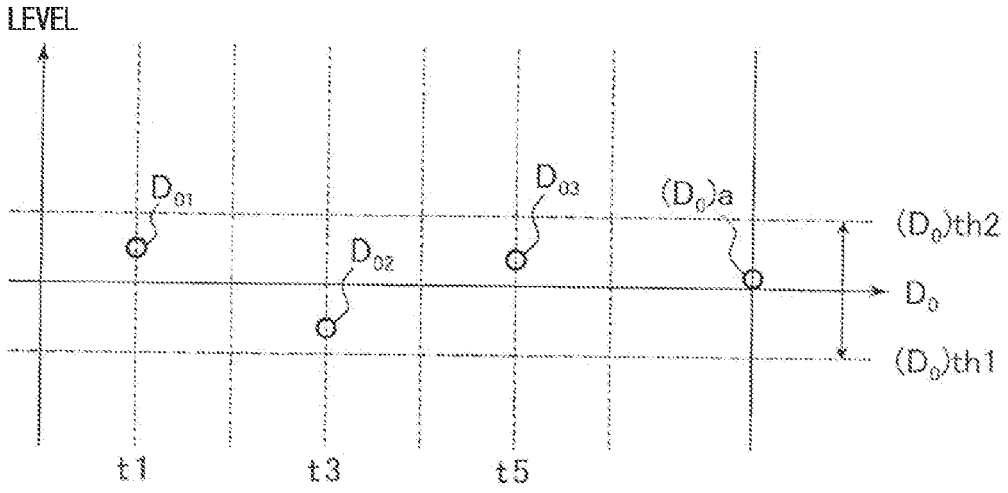
FIG. 6A is an explanatory drawing that shows noise assessment by the second noise assessment mode.
Figure 6B:
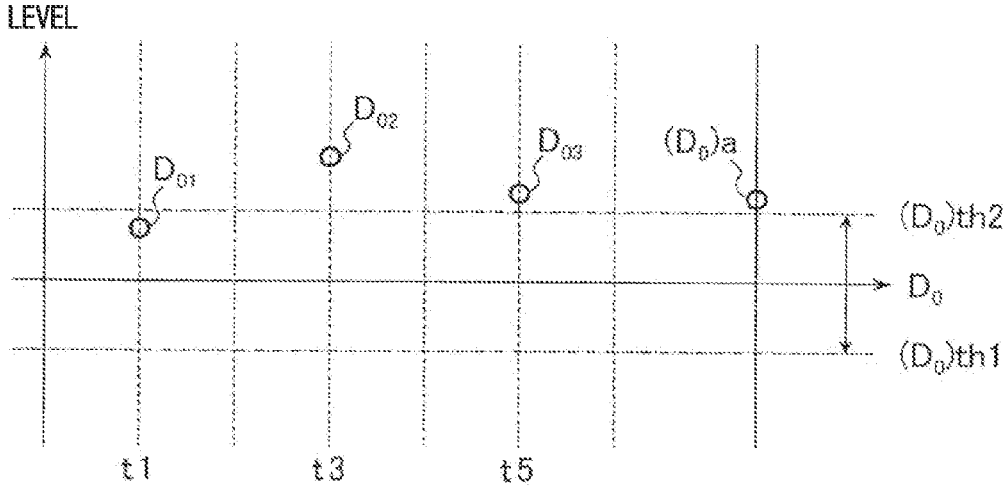
FIG. 6B is an explanatory drawing that shows noise assessment by the second noise assessment mode.

FIG. 6A and FIG. 6B show examples of noise assessment according to the second noise assessment mode. In FIG. 6A, the moving average $(D_0)$ of the zero-point light reception values $D_{01}$, $D_{02}$, $D_{03}$ in the case of no noise is within the upper limit value $(D_0)$th2 and the lower limit value $(D_0)$th1 that determine the predetermined range centered on the zero-point fixed value $D_0$. In this case, noise is not assessed as being mixed in. In contrast, in the case of noise being mixed in as shown in FIG. 6B, the moving average value $(D_0)$a of the zero-point light reception values $D_{01}$, $D_{02}$, $D_{03}$ is above the upper limit value $(D_0)$th2 of the predetermined range centered on the zero-point fixed value $D_0$. In this case, noise is assessed as being mixed in.

In the case of the noise assessing-processing portion 38 having assessed noise as being mixed in, as described below, it prohibits updating of the zero-point moving average value $(D_0)$ma as noise removal processing. For that reason, the zero-point moving average value $(D_0)$ma is within the upper limit value $(D_0)$th2 and the lower limit value $(D_0)$th1 that determine the predetermined range centered on the zero-point fixed value $D_0$.

(Third Noise Assessment Mode)

In the third noise assessment mode, the noise assessing-processing portion 38 assesses noise as being mixed in when the difference between the maximum value and the minimum value of the smoke light reception values $D_{S1}$, $D_{S2}$, $D_{S3}$ of the three instances detected by the light reception signal detecting portion 34 is greater than or equal to a predetermined threshold value $\Delta D_S$.

Figure 7A:
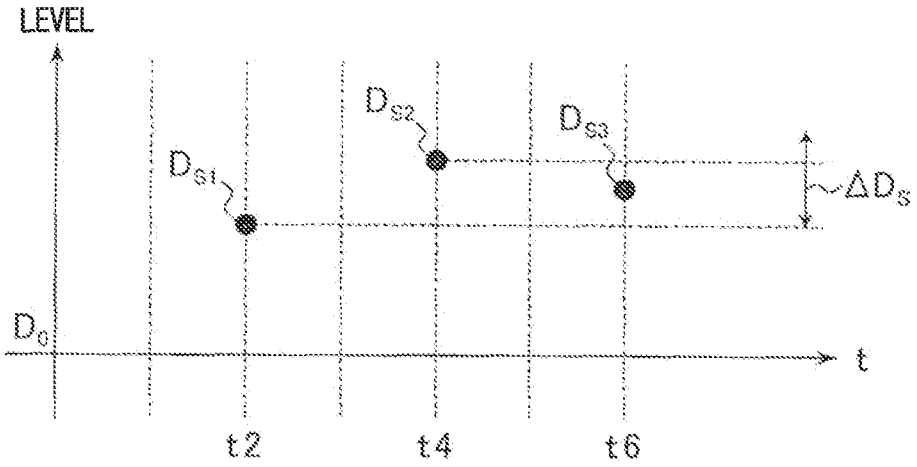
FIG. 7A is an explanatory drawing that shows noise assessment by the third noise assessment mode.
Figure 7B:
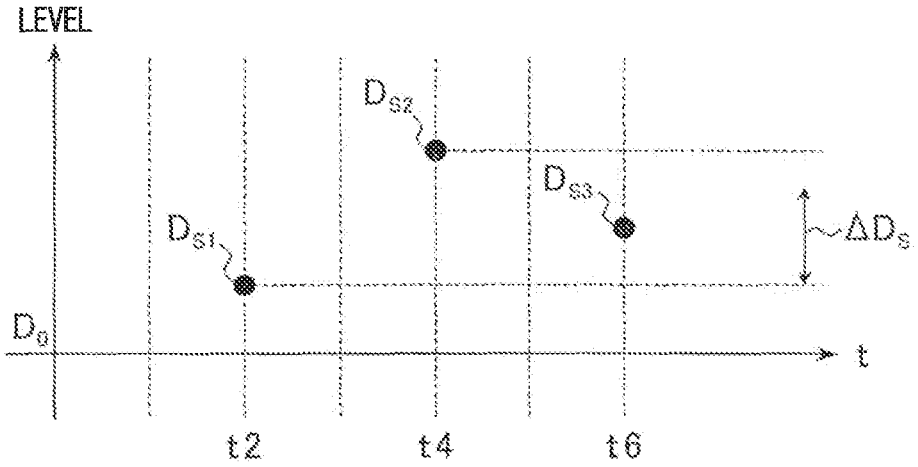
FIG. 7B is an explanatory drawing that shows noise assessment by the third noise assessment mode.

FIG. 7A and FIG. 7B show an example of noise assessment by the third noise assessment mode. In FIG. 7A, the difference between the maximum value $D_{S2}$ and the minimum value $D_{S1}$ $(D_{S2}-D_{S1})$ of the smoke light reception values $D_{S1}$, $D_{S2}$, $D_{S3}$ in the case of no noise is less than the predetermined threshold value $\Delta D_S$, and so the dispersion is small. In this case, noise is not assessed as being mixed in. In contrast, in the case of noise being mixed in as shown in FIG. 7B, the difference between the maximum value $D_{S2}$ and the minimum value $D_{S1}$ $(D_{S2}-D_{S1})$ is greater than the predetermined threshold value $\Delta D_S$. In this case, noise is assessed as being mixed in.

(Fourth Noise Assessment Mode)

In the fourth noise assessment mode, the noise assessing-processing portion 38 assesses noise as being mixed in when the difference between the maximum value and the minimum value of the zero-point light reception values $D_{01}$, $D_{02}$, $D_{03}$ of the three instances detected by the light reception signal detecting portion 34 is equal to or greater than a predetermined threshold value.

Figure 8A:
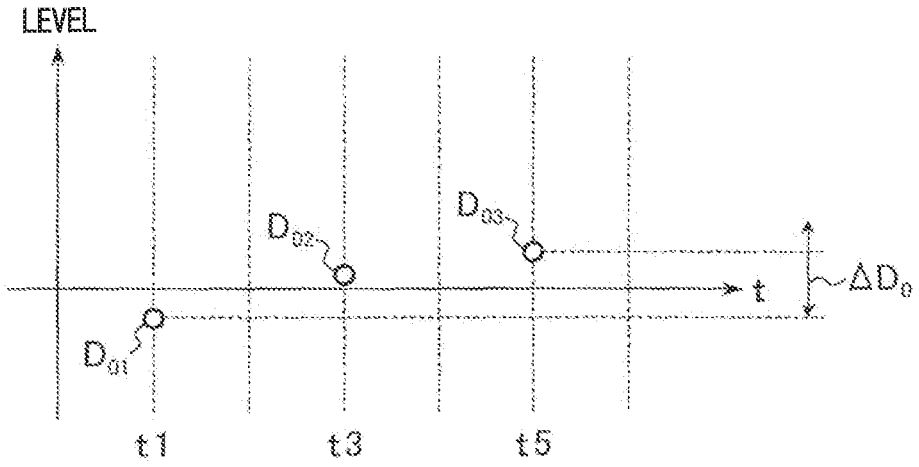
FIG. 8A is an explanatory drawing that shows noise assessment by the fourth noise assessment mode.
Figure 8B:
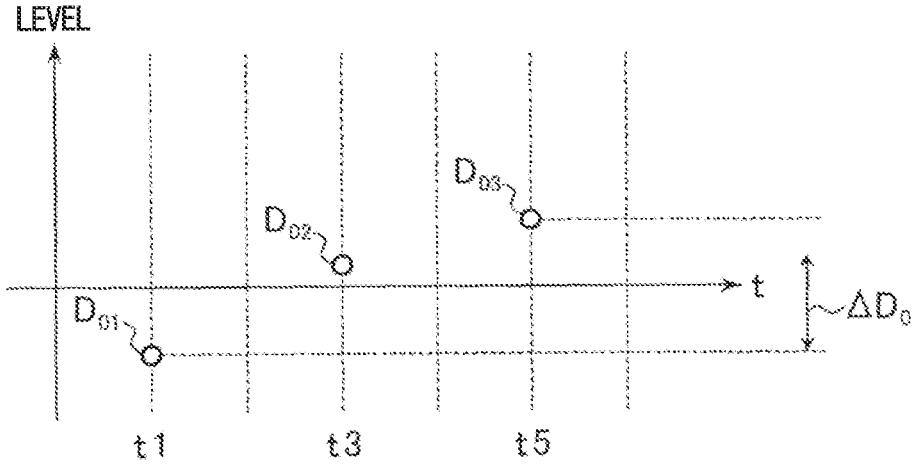
FIG. 8B is an explanatory drawing that shows noise assessment by the fourth noise assessment mode.

FIG. 8A and FIG. 8B show examples of noise assessment by the fourth noise assessment mode. In FIG. 8A, the difference between the maximum value $D_{03}$ and the minimum value $D_{01}$ $(D_{03}-D_{01})$ of the zero-point light reception values $D_{01}$, $D_{02}$, $D_{03}$ in the case of there being no noise is less than the predetermined threshold value $\Delta D_0$, and so the dispersion is small. In this case, noise is not assessed as being mixed in. In contrast, in the case of noise being mixed in as shown in FIG. 8B, the difference between the maximum value $D_{03}$ and the minimum value $D_{01}$ $(D_{03}-D_{01})$ is greater than the predetermined threshold value $\Delta D_0$. In this case, noise is assessed as being mixed in.

(Fifth Noise Assessment Mode)

In the fifth noise assessment mode, the noise assessing-processing portion 38 assesses noise as being mixed in when any one of the zero-point light reception values $D_{01}$, $D_{02}$, $D_{03}$ of the three instances detected by the light reception signal detecting portion 34 exceeds the smoke light reception values $D_{S1}$, $D_{S2}$, $D_{S3}$ detected next.

Figure 9A:
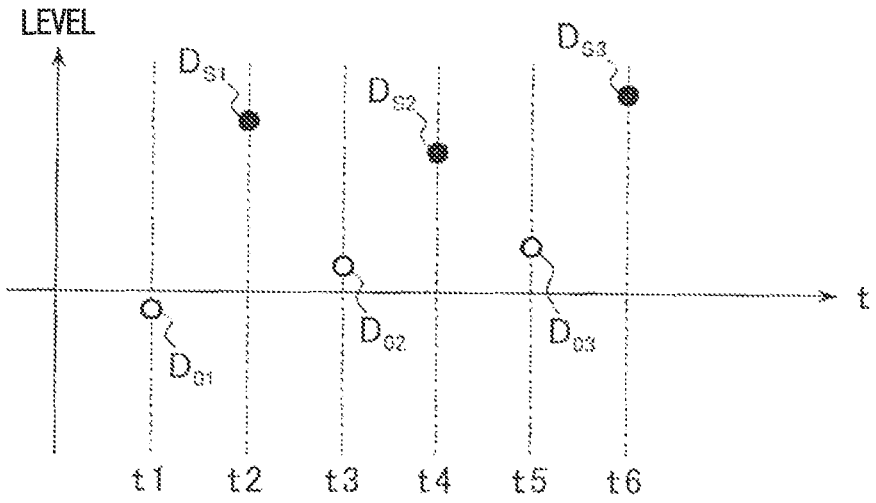
FIG. 9A is an explanatory drawing that shows noise assessment by the fifth noise assessment mode.
Figure 9B:
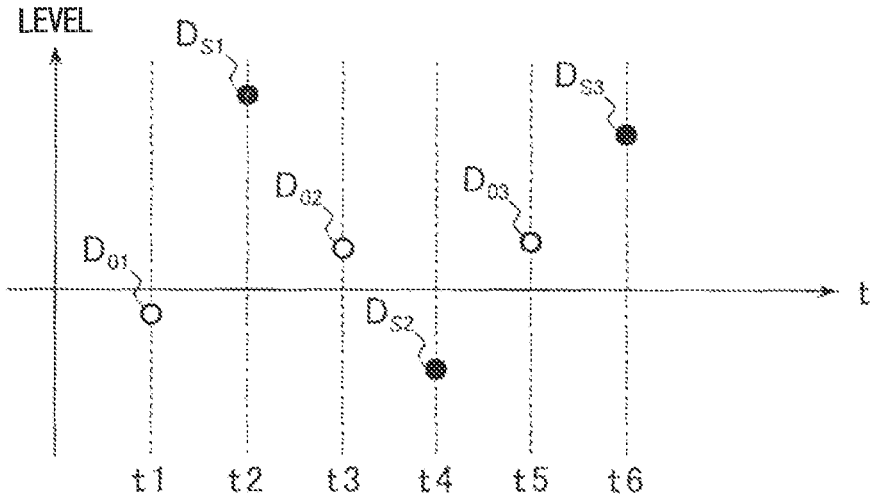
FIG. 9B is an explanatory drawing that shows noise assessment by the fifth noise assessment mode.

FIG. 9A and FIG. 9B show examples of noise assessment by the fifth noise assessment mode. FIG. 9A shows the zero-point light reception values $D_{01}$, $D_{02}$, $D_{03}$ and the smoke light reception values $D_{S1}$, $D_{S2}$, $D_{S3}$ in the case of no noise, in which first time $D_{01}<D_{S1}$
second time $D_{02}<D_{S2}$
third time $D_{03}<D_{S3}$ so that the zero-point light reception values are less than the smoke light reception values for all three times. In this case, noise is not assessed as being mixed in.

In contrast, in the case of noise being mixed in as shown in FIG. 9B, first time $D_{01}<D_{S1}$
second time $D_{02}>D_{S2}$
third time $D_{03}<D_{S3}$ so that the zero-point light reception value $D_{02}$ exceeds the smoke light reception value $D_{S2}$ at the second time. In this case, noise is assessed as being mixed in.

(Noise Removal Processing)

It is desirable for the noise assessing-processing portion 38, in the case of assessing noise to be mixed in by any one or more assessment modes of the first noise assessment mode to the fifth noise assessment mode, to prohibit updating of the zero-point moving average value $(D_0)$ma in the smoke detection operation of the smoke detecting portion 34, as noise removal processing. By prohibiting updating, it is possible to inhibit the zero-point moving average value $(D_0)$ma being influenced by noise.

Figure 10:
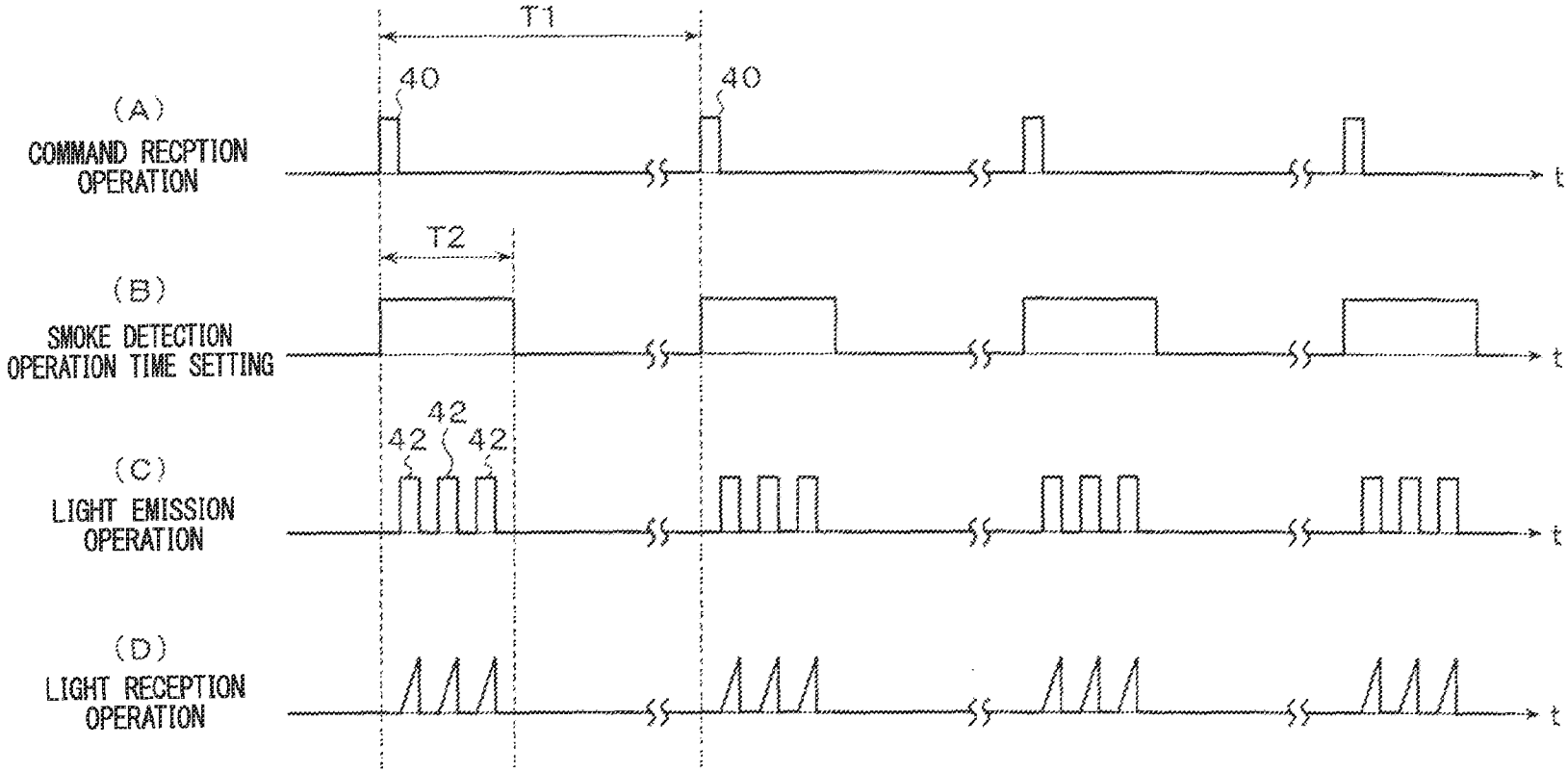
FIG. 10 is a time chart that shows the operation of the fire detector in the case of the period being shortened by noise assessment.

Also, the noise assessing-processing portion 38, in the case of assessing noise to be mixed in by any one or more assessment modes of the first noise assessment mode to the fifth noise assessment mode, changes the period T0=3 seconds due to receiving three times the sampling command 40 transmitted from the alarm control panel 12 as shown in (A) of FIG. 2 to period T1=1 second due to the one-time reception of the shorter sampling command 40 as shown in FIG. 10. The period T1 that is changed by this noise assessment is preferably returned to the original period T0 from the next period in the case of noise subsequently no longer being assessed as being mixed in.

As described above, in the case of noise being assessed as being mixed in, by changing the predetermined period T0 that sets the smoke detection operation time T2 to the shorter predetermined period T1, in the case of noise being assessed, the frequency of noise assessment thereafter increases, therefore it is possible to rapidly perform continuance of the noise removal processing based on noise assessment, and release of the noise removal processing based on noise non-assessment.

(Operation of Fire Detector)

Figure 11:
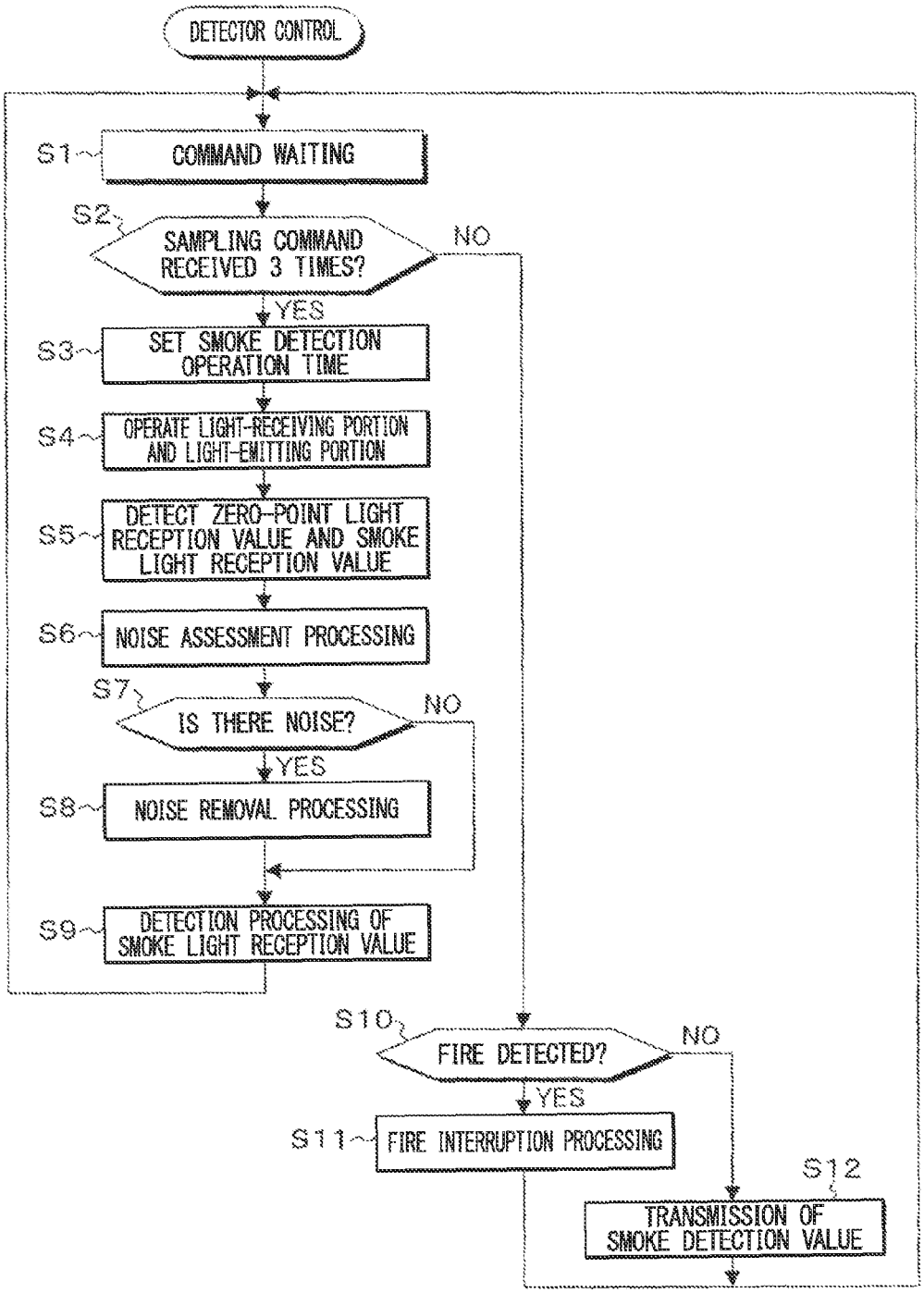
FIG. 11 is a flowchart that shows a fire detection operation executed by a program in the fire detector of FIG. 1.

FIG. 11 is a flowchart that shows an example of the smoke detection operation (fire detection operation) that the fire detector 10 according to the present embodiment of FIG. 1 executes via a program.

In FIG. 11, in Step S1 (hereinbelow "step" shall be omitted), it is in a state of waiting for a sampling command to be transmitted from the alarm control panel 12 via the transmission portion 16. Then, in S2, when the timing control portion 32 of the control portion 18 detects the reception of the sampling command transmitted from the alarm control panel 12 three times, that is, when it detects the attainment of the period T0, the process proceeds to S3, where it sets the smoke detection operation time T2. Next, in S4, the timing control portion 32 gives instructions to the received-light amplifying portion 30 to put the received-light amplifying portion 30 into operating state during the smoke detection operation time T2. Moreover, the timing control portion 32 gives instructions to the light emission driving portion 20 to perform light emission driving of the infrared LED 26 by repeating three times light-emission driving of a duration of T6=50 microseconds at each light emission timing of the light emission periods T3, T4, T5.

Next, the process proceeds to S5, where the light that is emitted from the infrared LED 26 at the light emission stop timings and light emission timings of three times during the smoke detection operation time T2 is received by the photodiode 28. The light reception signal that is output from the received-light amplifying portion 30 is subjected to AD conversion by the light reception signal detecting portion 34, and the zero-point light reception values $D_{01}$, $D_{02}$, $D_{03}$ and smoke light reception values $D_{S1}$, $D_{S2}$, $D_{S3}$ are detected and held.

Next, the process proceeds to S6, where based on the zero-point light reception values $D_{01}$, $D_{02}$, $D_{03}$ and smoke light reception values $D_{S1}$, $D_{S2}$, $D_{S3}$ detected and held by the light reception signal detecting portion 34, the noise assessing-processing portion 38 performs noise assessment processing by the first noise assessment mode to fifth noise assessment mode described above. In the case of noise being assessed as not mixed in in S7 from the result of this noise assessment process, the process proceeds to S9, which updates the zero-point moving average value that was held in the previous period based on the zero-point light reception values $D_{01}$, $D_{02}$, $D_{03}$ detected and held by the light reception signal detecting portion 34, and detects the smoke detection value based on the zero-point light reception values $D_{S1}$, $D_{S2}$, $D_{S3}$ and the updated zero-point moving average value.

Then, the process returns to the command waiting of S1, and when it is determined that there has been no reception of a sampling command in S2, that is, in the case of not reaching the next period T0, the process proceeds to Step S10, and the smoke detection value detected in S9 is compared with a predetermined smoke threshold value. If the result of this comparison is that the smoke detection value is less than the fire threshold value, the process proceeds to S12, and in the case of detecting the reception of a polling command that matches its own address transmitted from the alarm control panel 12 via the transmission portion 16, it instructs the transmission portion 16 to transmit to the alarm control panel 12 a response signal that includes the smoke detection value.

In contrast, in the case of the smoke detection value being equal to or greater than the fire threshold value in S10, a fire is detected and the process proceeds to S11, where a fire interruption process is performed. In the fire interruption process of S11, it instructs the transmission portion 16 to transmit a fire interruption signal to the alarm control panel 12, and in the case of receiving via the transmission portion 16 a search command that is transmitted from the alarm control panel 12 based on the reception of this fire interruption signal, it instructs the transmission portion 16 to transmit a response signal to the alarm control panel 12 to cause it to retrieve that the fire detector that transmitted the fire interruption signal is itself.

On the other hand, in the case of noise being assessed as being mixed in S7, the process proceeds to S8, and as the noise removal processing, it prohibits updating of the zero-point moving average value held in the previous period based on the zero-point light reception values $D_{01}$, $D_{02}$, $D_{03}$ detected and held by the light reception signal detecting portion 34, and the process proceeds to S9 to detect the smoke detection value based on the zero-point moving average value held in the previous period and the smoke light reception values $D_{S1}$, $D_{S2}$, $D_{S3}$ of three instances detected this time, and then returns to Step S1.

In the case of performing the noise assessment and returning to S2 via S8, S9 and S1, the determination period T0 that is determined by the three receptions of the sampling command is changed to a shorter period T1 that is determined by one reception of the sampling command, and the processes of Steps S3 to S12 are performed. Also, after changing to the shorter period T1 that is determined by one reception of the sampling command, in the case of assessing no noise and returning to S2 via S9 and S1, it returns to the original period T0 that is determined by three receptions of the sampling command.

Other Examples of the Present Embodiment

Noise Removal Processing

In the aforementioned embodiment, as noise removal processing in the case of noise being assessed, updating of the zero-point moving average value that was calculated and held in the previous period is prohibited. However, the essence of the present invention need only be the capability to prevent a fire judgment by a smoke detection value having the possibility of containing noise. For that reason, other than prohibiting updating of the zero-point moving average value, the fire judgment processing by the smoke detecting portion may be prohibited, or the transmission of the fire interruption signal may be prohibited.

(On/Off-Type Fire Detector)

Also, the aforementioned embodiment takes as an example a so-called analog fire detector that, based on a sampling command from the alarm control panel, performs a smoke detection operation and transmits to the alarm control panel a smoke detection signal (smoke detection value). However, a so-called on/off-type fire detector may also be used that sets the predetermined smoke detection operation time T2 in each predetermined period T0 and performs the smoke detection operation by the fire detector itself, and in the case of judging there to be a fire from the smoke detection value, transmits a fire reporting signal to the alarm control panel to output a fire alarm.

(Photoelectric Smoke Detecting Portion)

The fire detector according to the aforementioned embodiment is provided with a scattered light-type smoke detecting portion, however, as a photoelectric smoke detecting portion other than that, a light extinction type smoke detecting portion that detects attenuation of smoke from a fire with light from a light-emitting portion, or a reflection-type smoke detecting portion that irradiates light from a light-emitting portion to a reflective plate arranged via a smoke inflow space, and detects smoke by receiving with a light-receiving portion that reflected light may be used.

(Relay Board)

In addition, the aforementioned embodiment took as an example an equipment configuration that connects a fire detector to an alarm control panel, but the same effect is obtained with an equipment configuration that connects a plurality of relay boards to the alarm control panel, and connects a plurality of fire detectors in the manner of FIG. 1 to transmission paths that are drawn out from each relay board.

(Miscellaneous)

In addition, the present invention is not limited to the aforementioned embodiment, includes suitable modifications that do not impair the object and advantages thereof, and furthermore is not limited by the numerical values shown in the aforementioned embodiment.

INDUSTRIAL APPLICABILITY

By using the aforementioned fire detector, it is possible to reliably assess noise and perform noise removal processing without missing the occurrence state of varying noise such as instantaneous noise in which noise mixes into either one or both of the zero-point light reception signal of the light emission stop timing and the smoke light reception signal of the light emission timing, randomly generated noise, or noise that continues for a comparatively long time. As a result, it is possible to judge a fire without errors by inhibiting the effect of noise.

DESCRIPTION OF THE REFERENCE SYMBOLS

10: Fire detector
12: Alarm control panel
14: Transmission path
16: Transmission portion
18: Control portion
20: Light-emitting portion
22: Light-receiving portion
24: Light emission driving portion
26: Infrared LED
28: Photodiode
30: Received-light amplifying portion
32: Timing control portion
34: Light reception signal detecting portion
36: Smoke detecting portion
38: Noise assessing-processing portion

The invention claimed is:

1. A fire detector comprising:

a light-emitting portion that repeats stopping of light emission and light emission a plurality of number of times in predetermined light emission periods during a predetermined smoke detection operation time set for each first period;

a light-receiving portion that receives the light emitted from the light-emitting portion and outputs a light reception signal during the smoke detection operation time;

a light reception signal detecting portion that detects as a zero-point light reception signal the light reception signal that the light-receiving portion outputs at each light emission stop timing of the smoke detection operation time, and detects as a smoke light reception signal the light reception signal that the light-receiving portion outputs at each light emission timing;

a smoke detecting portion that detects a smoke detection signal based on the zero-point light reception signals of a plurality of number of times and the smoke light reception signals of a plurality of number of times detected by the light reception signal detecting portion; and a noise assessing-processing portion that assesses a presence of mixing-in of noise to the light reception signal based on the zero-point light reception signals of a plurality of number of times and the smoke light reception signals of a plurality of number of times, and carries out noise removal processing in a case of having assessed that the noise is mixed in; wherein the smoke detecting portion updates a first zero-point moving average value, which is calculated from a predetermined number of zero-point light reception signals detected by a previous period and held, as a second zero-point moving average value based on the zero-point light reception signals of a plurality of number of times, and detects the smoke detection signal based on this second zero-point moving average value and the smoke light reception signals of a plurality of number of times; and the noise assessing-processing portion, in a case of having assessed noise to be mixed in the zero-point light reception signal, carries out noise removal processing that prohibits updating of the first zero-point moving average value by the smoke detecting portion.

2. The fire detector according to claim 1, wherein the light emission periods are set to periods that differ from a noise period corresponding to a predetermined noise frequency.

3. The fire detector according to claim 1, wherein the noise assessing-processing portion includes a first noise assessment mode that assesses the noise as being mixed in when any of the zero-point light reception signals of a plurality of number of times is equal to or greater than an upper limit value or equal to or lower than a lower limit value of a predetermined range centered on a predetermined zero-point moving average value;

a second noise assessment mode that assesses the noise as being mixed in when the moving average value of the zero-point light reception signals of a plurality of number of times is equal to or greater than an upper limit value or equal to or lower than a lower limit value of a predetermined range centered on a predetermined zero-point fixed value;

a third noise assessment mode that assesses the noise as being mixed in when a difference between a maximum value and a minimum value of the smoke light reception signals of a plurality of number of times is greater than or equal to a predetermined threshold value;

a fourth noise assessment mode that assesses the noise as being mixed in when a difference between a maximum value and a minimum value of the zero-point light reception signals of a plurality of number of times is greater than or equal to a predetermined threshold value; and a fifth noise assessment mode that assesses the noise as being mixed in when any of the zero-point light reception signals of a plurality of number of times exceeds the smoke light reception signals detected next, and the noise assessing-processing portion carries out the noise removal processing in a case of having assessed that the noise is mixed in based on one or multiple combinations of the first noise assessment mode to the fifth noise assessment mode.

4. The smoke detector according to claim 1, wherein the noise assessing-processing portion changes the first period to a second period that is shorter when it has assessed that noise is mixed in; and returns the second period to the first period after being changed to the second period and when it no longer assesses that noise to be mixed in.

5. The fire detector according to claim 1, wherein the smoke detecting portion finds an average value of the values obtained by subtracting the first zero-point moving average value or the second zero-point moving average value from each of the smoke light reception signals of a plurality of number of times as the smoke detection signal.

* * * * *